US006579038B1

(12) United States Patent
McAllister et al.

(10) Patent No.: US 6,579,038 B1
(45) Date of Patent: Jun. 17, 2003

(54) REVETMENT BLOCK

(76) Inventors: Kenneth L. McAllister, 600 Covington Grove Blvd., Bowling Green, KY (US) 42101; Kenny W. McCoy, 4438 Sandy Creek Rd., Morgantown, KY (US) 42261; Derek W. Dice, 1712-B Rockingham Ave., Bowling Green, KY (US) 42104

( * ) Notice: Subject to any disclaimer, the term of this patent is extended or adjusted under 35 U.S.C. 154(b) by 0 days.

(21) Appl. No.: 10/044,326

(22) Filed: Jan. 10, 2002

(51) Int. Cl.[7] ..... E02B 3/14

(52) U.S. Cl. ..... 405/16; 405/18; 405/33; 52/603; 52/604; 52/606; 52/590.2; 52/592.1; 404/38; 404/40; 404/41

(58) Field of Search ..... 405/15–18, 21, 405/22, 33; 52/596, 603, 604, 606, 608, 609, 747.12, 590.2, 591.1, 591.6; 404/40, 41, 39, 34, 37, 38; D25/112–116, 118; D21/484, 489, 491–492, 500–505

(56) References Cited

U.S. PATENT DOCUMENTS

| | | | | | |
|---|---|---|---|---|---|
| 1,320,647 | A | | 11/1919 | Pomerantz | |
| 2,876,628 | A | | 3/1959 | Dixon, Jr. | |
| 3,557,669 | A | * | 1/1971 | Fenton | 404/42 |
| D254,034 | S | * | 1/1980 | Amber | D25/152 |
| 4,227,829 | A | | 10/1980 | Landry, Jr. | |
| 4,370,075 | A | | 1/1983 | Scales | |
| 4,465,398 | A | * | 8/1984 | Knudsen | 405/16 |
| 4,564,311 | A | | 1/1986 | Scales | |
| D285,586 | S | * | 9/1986 | Murdough et al. | D21/491 |
| 4,850,739 | A | * | 7/1989 | Gargollo | 404/41 |
| 5,484,230 | A | | 1/1996 | Rudloff | |
| 5,556,228 | A | | 9/1996 | Smith | |
| 5,779,391 | A | | 7/1998 | Knight | |
| 6,071,041 | A | | 6/2000 | Knight | |
| D463,041 | S | * | 9/2002 | Dice et al. | D25/118 |
| 6,508,607 | B1 | * | 1/2003 | Smith et al. | 405/20 |

FOREIGN PATENT DOCUMENTS

| | | | | |
|---|---|---|---|---|
| GB | 2134561 | * | 8/1984 | 405/16 |
| GB | 2167780 | * | 6/1986 | 52/561 |
| GB | 2211533 | * | 7/1989 | 405/16 |

* cited by examiner

*Primary Examiner*—Heather Shackelford
*Assistant Examiner*—Jong-Suk Lee
(74) *Attorney, Agent, or Firm*—John F. Salazar; James E. Cole; Middleton Reutlinger

(57) ABSTRACT

A revetment block for use as end blocks with an articulating revetment mat. The revetment mat end blocks having a size of about one and a half times larger than the standard blocks of the revetment mat and are formed of precast concrete. The block preferably has four sidewalls each with a vertical portion and a tapered portion. The sidewalls have a plurality of projections and recesses for interlocking with adjacent revetment blocks, wherein some of the recesses form openings with adjacent blocks. The revetment block also has at least one dome with a pair of openings extending from an upper dome plateau to a lower surface of the block. The revetment block further comprises a pair of openings extending from the lower surface of the block to an upper surface. Extending through parallel sides of the revetment block are a plurality of ducts for cable which interlocks the revetment mat rows. When used as end blocks of a revetment mat, the mat has evenly aligned edges and resists upward lift and turning associated with half blocks of the prior art.

34 Claims, 10 Drawing Sheets

REVETMENT BLOCK

BACKGROUND OF THE INVENTION

1. Technical Field of the Invention

The present invention relates generally to a revetment block. More particularly, the invention relates to a revetment block, used along the outer perimeter of a revetment mat, being sized to eliminate the use of half size revetment blocks, which tend to lift the edges of the revetment mat due to the flow of water thereover. Additionally, a revetment mat is disclosed adapted to use the above described revetment block along its outer perimeter and thus inhibit upward thrust on the mat from the peripheral edge.

2. Description of the Related Art

Revetment mats are used to inhibit soil erosion from areas of flowing water along, for instance, shorelines, spillways, overflow channels, drainage channels, boat ramps, and the like. Current revetment mats are formed from articulated concrete blocks that interlock together and conform to specific hydraulic performance characteristics.

U.S. Pat. No. 4,370,075, issued to Scales, FIG. 3 shows a common characteristic of revetment mats. For example, the blocks of a top row are offset and not aligned with the blocks of an immediately lower row so as to form an aligned column. This offset alignment of rows is called a "running bond" and is desirable because the blocks are interlocked such that each block is in contact with a greater number of blocks for a more stable configuration. However, as a result, the edges of the revetment mat are not uniform and, as best shown in FIGS. 3 and 5, half sized blocks must be added to the ends of alternating revetment mat rows to make the row ends evenly aligned. There are several problems associated with half sized blocks. First, the half-sized blocks have contact along fewer sides or surfaces than blocks within the edges of the mat. Second, the half-size blocks have contact with fewer total blocks. These problems lead to a third problem of displacement of the half-size block. Due to their smaller size and decreased contact with adjacent blocks, the half size blocks tend to lift and rotate from an upward hydraulic thrust. Due to cable connections extending transverse to the mattress rows, the uplift of the half-size blocks can result in the curling of the edges of the revetment mat. This is highly undesirable.

In view of the deficiencies in known revetment blocks, it is apparent that a revetment block is needed for use with a revetment mat having a size which makes revetment mat rows evenly aligned, having improved hydraulic performance characteristics, and which inhibits uplift of the revetment block.

SUMMARY OF THE INVENTION

It is an object of the present invention to provide a revetment block having dimensions which, when used in a revetment mat, result in even edges of a revetment mat.

It is a further objective of this invention to provide a revetment block having a size which inhibits upward hydraulic thrust.

It is an even further objective of this invention to provide a revetment block which is used to form a revetment mat and inhibits revetment mat edge curling.

It is still an even further objective of this invention to provide a revetment block having at least one dome which slows the velocity of water passing above the revetment mat.

It is yet an even further objective to provide a revetment block having a plurality of holes therein for foliage growth.

It is also an object of the present invention to provide a revetment block having tapered sidewalls.

A revetment block, comprising a substantially rectangular block having two U-shaped vertical recesses along each of a first and a second sides, a third side having a pair of U-shaped recesses and three projections, a fourth side having three U-shaped recesses opposing the three projections of the third side and a pair of projections opposing the recesses of the third side. The revetment block has a top and a bottom surface, the top surface has a dome thereon, the dome surrounds a first and a second tapered wall opening. A third opening and a fourth opening extend from the top surface to the bottom surface of the block. The first and second tapered wall openings extend vertically downward through the dome to the bottom surface of the block. The second side has a half-dome surrounding the pair of tapered U-shaped recesses. The dome and the half-dome are formed by a curvilinear wall extending from the top surface to a flat upper plateau. The first, second, third, and fourth openings are preferably substantially rectangular. The U-shaped recesses of the first and second sides each forming one-half openings.

The revetment block further comprises at least one duct extending through said revetment block, preferably from one recess to an opposed projection. The at least one duct extends longitudinally between said third and fourth sides.

The first and second openings are vertically tapered from a wider upper portion to a narrower lower portion. The U-shaped recesses of the second side are tapered. The first, third, and fourth sides are tapered adjacent the top surface of the revetment block.

All of the above outlined objectives are to be understood as exemplary only and many more objectives of the invention may be gleaned from the disclosure herein. Therefore, no limiting interpretation of the objectives noted is to be understood without further reading of the entire specification, claims, and drawings included herewith.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENT

The Revetment Block

The present invention will now be described in conjunction with the drawings, referring initially to FIG. 1, a revetment block 10 having a "block and a half" size and a right-hand design is shown. The block and a half design is denoted as right-hand or left-hand due to its placement on a revetment mat right side or left side of a row.

The revetment block 10 is formed from precast concrete according to a first embodiment of the present invention. The revetment block 10 has a substantially planar upper or top surface 12 and lower or bottom surface 15, and a plurality of sidewalls: first side 24*a*, second side 24*b*, third side 25*a*, and fourth side 25*b* extending between the upper surface 12 and the lower surface 15. The revetment block 10 generally has a substantially rectangular shape but may be any other desirable shape. The height of the block 10 may vary depending on the application and desired hydraulic characteristics, but is generally between 70 and 240 millimeters. When larger hydrodynamic forces are involved, the height of the block 10 may be increased.

Figure 3:
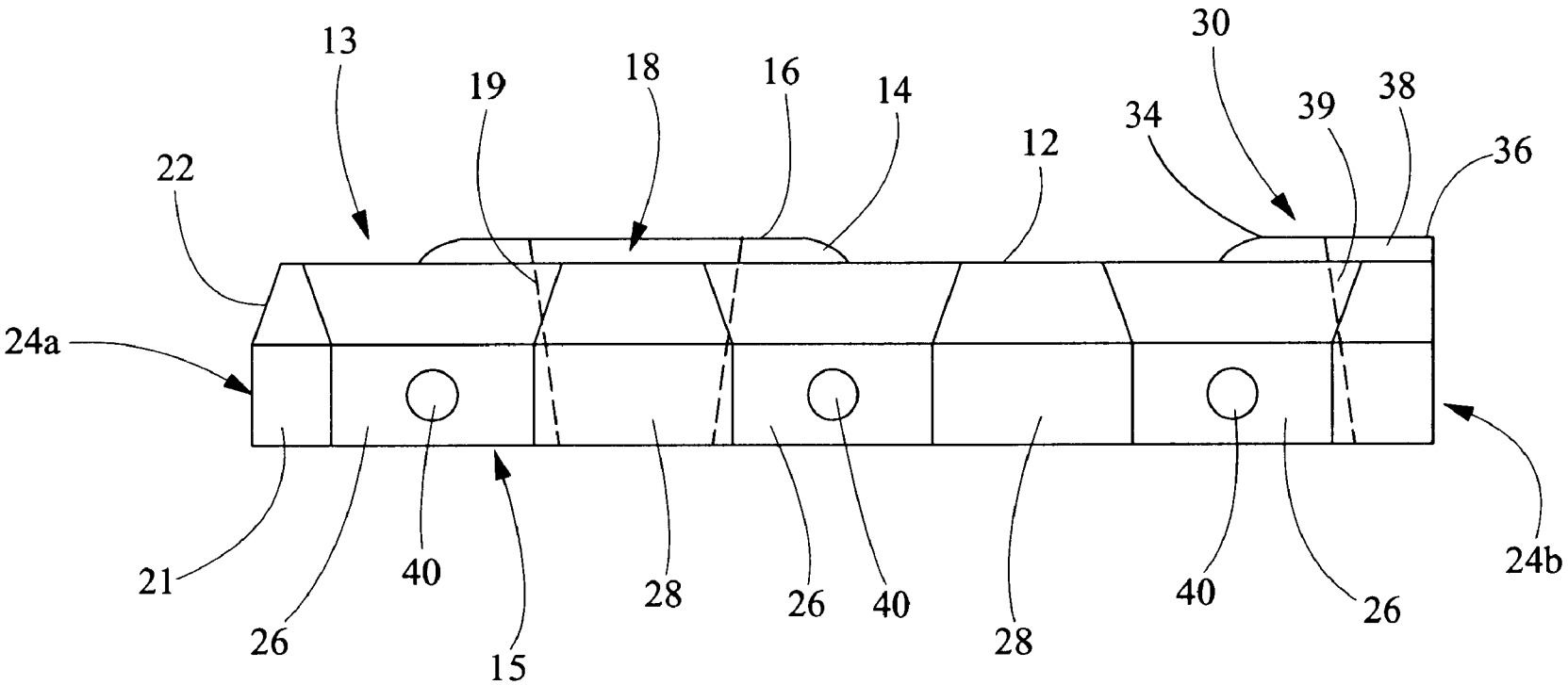
FIG. 3 shows a side view of the right-hand block and a half revetment block along line 3—3 of FIG. 2.
Figure 4:
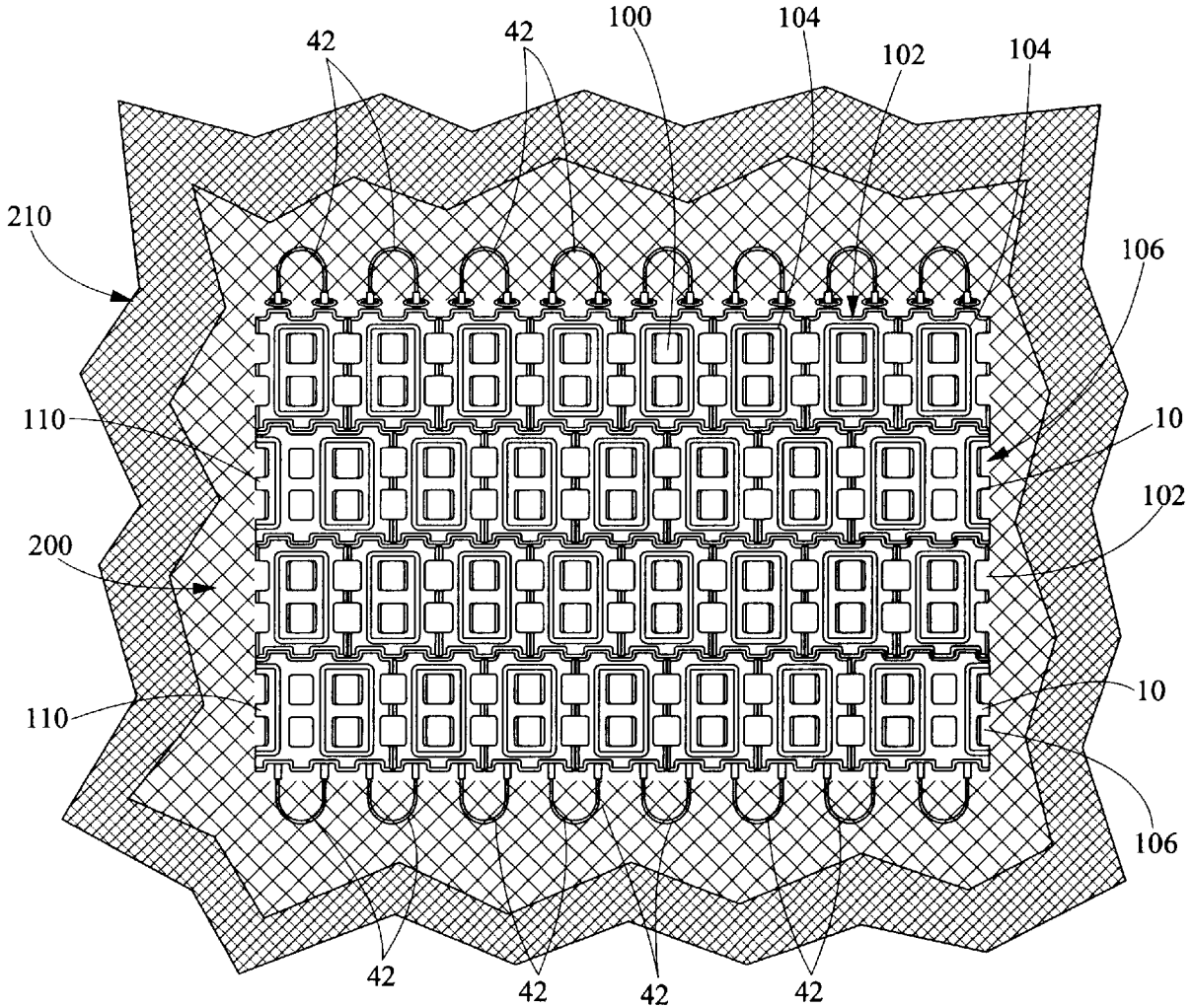
FIG. 4 shows a top view of the revetment mat of the present invention.

As shown in FIGS. 3 and 4, the lower or bottom surface 15 of the revetment block 10 may preferably be substantially flat or planar such as to make substantially continuous contact with either a substrate soil 210 or a filter media 200 which may preferably be located between the substrate soil 210 and revetment mat 100. The upper surface 12 of the revetment block 10 is preferably parallel with the lower surface 15 but may be designed differently depending on the application. In addition, the block 10 may have some gripping component built into the lower surface 15 to increase gripping efficiency of the block 10 to the filter media 200 or substrate soil 210.

Figure 2:
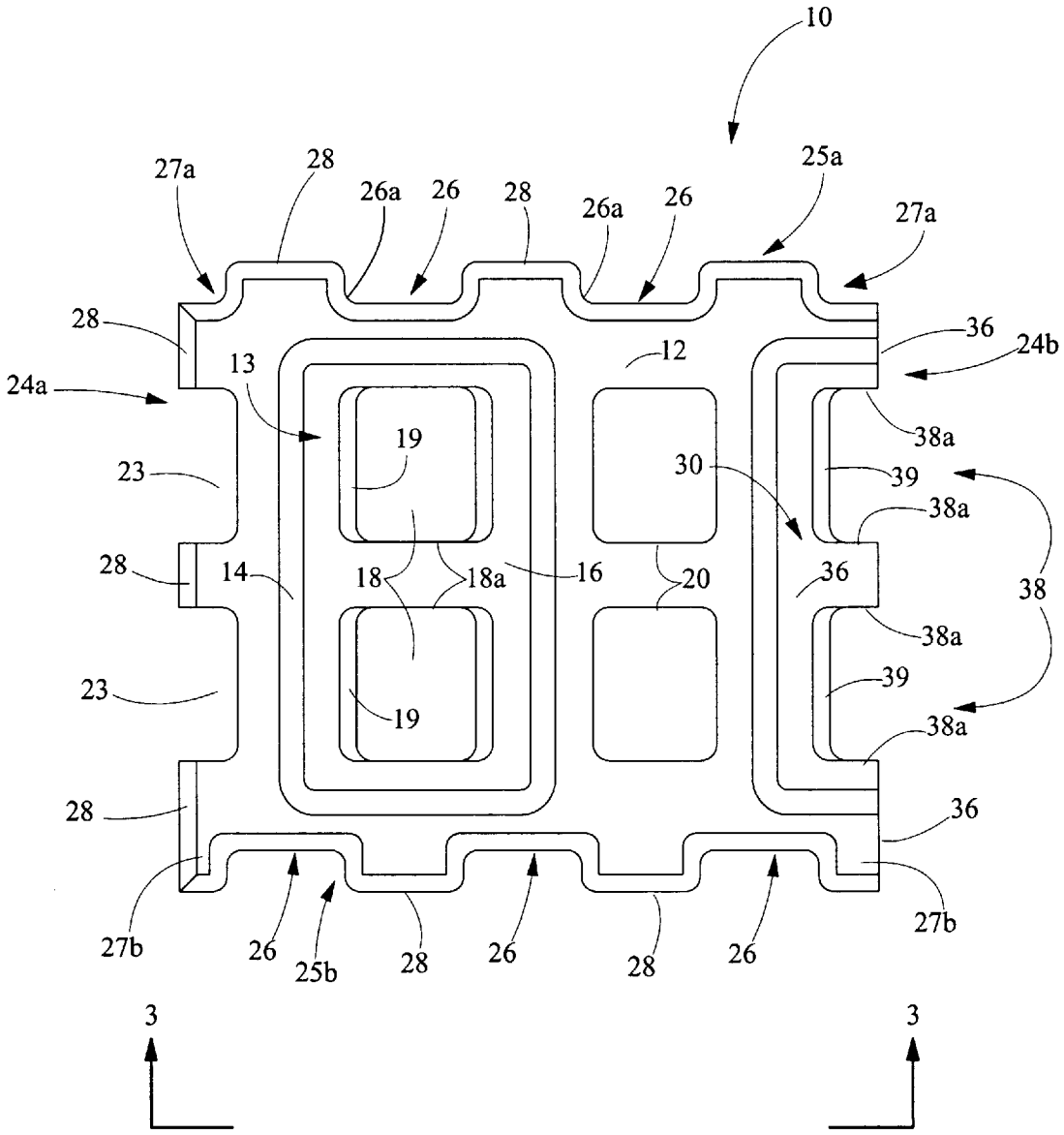
FIG. 2 shows a top view of the right-hand block and a half size revetment block of FIG. 1.

As shown in FIGS. 2 and 3, the upper surface 12 has at least one aperture or opening 20 extending through the block 10 to the lower surface 15. The at least one aperture or opening 20 allows foliage to grow through the block 10 from the substrate soil beneath the revetment mat 100, shown in FIG. 4. In other words, the foliage provides an anchor for the mat 100 and has a second advantage of adding an aesthetically pleasing appearance to the waterway. Another advantage of the openings 20 is that the openings 20 release hydrostatic pressure from beneath the revetment mat 100. The openings 20 allow water to flow through the blocks thereby relieving hydrostatic pressure therebeneath and reducing upward lift on the revetment mat 100. One final advantage of the apertures or holes 20 is that they dissipate energy such as from waves which may buffet the revetment mat 100. The at least one aperture 20 preferably has equal proportions with apertures 20 of other revetment blocks 10 so as to provide an aesthetically pleasing appearance when a revetment mat is formed.

The sidewalls 24*a*, 24*b*, 25*a*, 25*b* may be entirely tapered but are preferably include at least partially vertical sidewalls. The opposed sidewalls 24*a*, 24*b* are parallel and opposed sidewalls 25*a*, 25*b* are parallel. In combination the sidewalls 24*a*, 24*b*, 25*a*, 25*b* preferably form a quadrilateral extending between the upper surface 12 and lower surface 15. In the present embodiment, the sidewalls 24*a*, 25*a*, 25*b* have a vertical portion 21 and a tapered portion 22 extending above the vertical portion 21 to the upper surface 12 such that upper surface 12 has less surface area than lower surface 15. In addition, the tapered portions 22 also allow the revetment blocks 10 to facilitate articulation of the matrix over non-planar surfaces. The tapered portions 22 provide an aesthetically pleasing appearance as well as providing a location for particulate in the water to settle and fill in seams between blocks 10. Sidewall 24*b* is a vertical sidewall and does not have a tapered portion like sidewalls 24*a*, 25*a*, 25*b*. Sidewall 24*b* is not tapered because of the half-dome 30 which may abut an adjacent block with a half-dome. Within the opposed sidewalls 25*a*, 25*b* are a plurality of recesses 26 and projections 28. The recesses 26 are preferably U-shaped. As seen in FIGS. 2 and 3, side 24*a* of the revetment block 10 has preferably three projections 28 having a vertical portion 21 and tapered portions 22, as previously discussed. The side 24*a* also preferably has a pair of U-shaped recesses 23. However, unlike the projections 28, the recesses 23 do not have a tapered portion of sidewall. The recesses 23 are actually half of an opening or aperture 20 which is fully formed by placing an adjacent block 10 in the revetment mat. As shown in FIG. 2, apertures 20 do not have tapered walls and therefore recesses 23 are not tapered either. Also, apertures 20 and 18 are of similar size at the bottom surface 15 of the block but on the top surface 12 the dimensions may be such that the apertures 18 are larger. Tapered side walls will therefore decrease this dimension as the aperture moves from the top surface 12 to the bottom surface 15.

Opposed sidewall 24*b* also preferably has a pair of recesses 38 with sidewalls 38*a* and tapered walls 39. The opposed sidewall 24*b* also has preferably three projections 36. The projections 36 comprise a half-dome 30, which in cooperation with an adjacent block 10 may form a complete dome, and will be discussed in further detail below.

Opposed sidewall 25*a*, has at least one recess 26. The preferably two recesses 26 are U-shaped channels and having curved corners 26*a*. The U-shaped recesses 26 ease installation of adjacent interlocking blocks 10 of the revetment mat 100, yet still provide a firm fit. Between the recesses 26 are projections 28 also for interlocking with adjacent blocks 10. Additionally, the projections 28 and recesses 26 allow for an offset running bond fit which results in contact with at least four adjacent blocks. The projections 28 may be curvilinear, U-shaped, angled, or otherwise configured so long as the recesses 26 have a mating shape. At the ends of side 25*a* are corners 27*a*. The corners 27*a* are recessed or truncated to form half recesses. When placed adjacent another revetment block 10 having an adjacent truncated corner, a full channel or recess is formed by adjacent corners 27*a* in which a projection 28 can easily be fitted to interlock the revetment blocks 10 and stabilize the revetment mat 100. The recesses 26 and projections 28 are preferably of equal proportions so that blocks 10 are interchangeable with other blocks 10 of various manufacturing batches.

Figure 1:
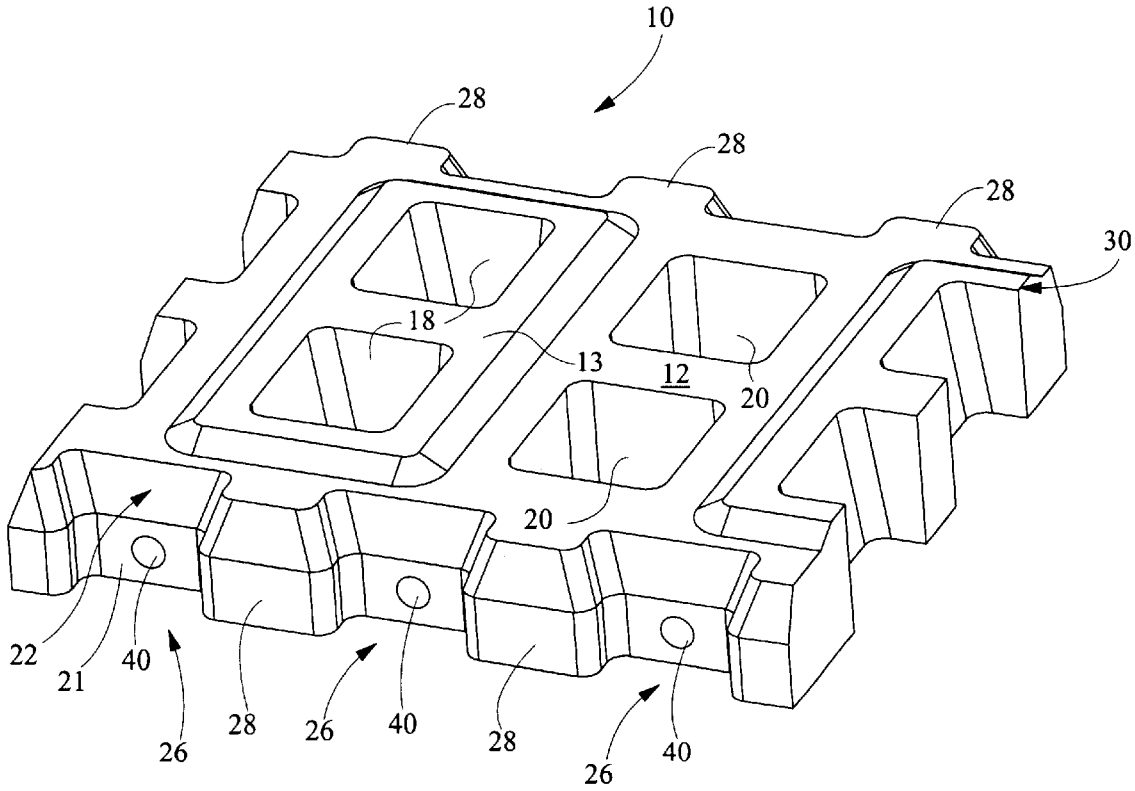
FIG. 1 shows a perspective view of the right-hand block and a half size revetment block of the present invention.

As shown in FIGS. 1, 3, and 4 extending between opposed sidewalls 25*a* and 25*b*, is at least one duct or tunnel 40. The duct 40 extends through the sidewalls 25*a* and 25*b* so that a cable 42 can pass therethrough to interlock rows 102,106 which form the revetment mat 100. Preferably, a duct 40 is located in each recess 26 along opposed sidewall 25*b* and extending through projection 28 in opposed sidewall 25*a*. The ducts 40 are positioned in this manner so as not to pass through apertures 18,20 and the foliage growing therein. The ducts 40 also allow water to flow through block 10 and thereby relieve hydrostatic pressure.

Opposed sidewall 25*b* also has a plurality of projections 28 and recesses 26. Since the preferably three ducts 40 extend from the projections 28 of sidewall 25*a* to recesses 26 of sidewall 25*b*, there are preferably three recesses 26 along sidewall 25*b*. The recesses 26 are preferably channel shaped and have equal proportions as the recesses 26 and projections 28 along sidewall 25*a*. Likewise, the projections 28 of sidewall 25*b* preferably have proportions equal to the recesses 26 and projections 28 of sidewall 25*a*. This allows the blocks to be interchangeable as well as interlock in both parallel bond and preferably, running bond schemes. At the ends of sidewalls 25*b* are corners 27*b*. Unlike the corners 27*a* which are truncated, each corner 27*b* forms a half projection 28. This allows revetment blocks 10 of a first row, for instance row 102, to interlock with an adjacent row, for instance 106, and form a mattress as clearly seen in FIG. 4. When a running bond is used, as shown in FIG. 4, both the standard size blocks 104 and the block and a half size revetment blocks 10, and block 110 discussed below, of the instant invention make contact with at least four other blocks. This results in a more stable interlock and stronger mat 100.

Referring again to FIGS. 2 and 3, extending upwardly from the upper surface 12 of the revetment block 10 maybe at least one dome 13. The dome 13 is formed of precast concrete and may have curvilinear walls or tapered walls 14 which extend from the upper surface 12 to a dome top or flat upper plateau 16. The dome top 16 is generally planar and has at least one aperture 18 extending from the dome top 16 through lower surface 15. The at least one aperture 18 is preferably substantially rectangular in shape but may be of any desired shape which allows for growth of foliage and relieves hydrostatic pressure. The apertures 18 have a pair of vertical walls 18*a* which are parallel to sidewalls 25*a* and 25*b* and tapered walls 19 which run parallel to walls 24*a* and 24*b*. The at least one aperture 18 also provide the advantages described with the at least one aperture 20 such as dissipating energy and releasing hydrostatic pressure. The dome 13 reduces the velocity of water over the revetment mat 100 inhibiting erosion and dissipating energy. The dome 13 also reduces the shear force caused by water moving above the revetment mat 100. Additionally, the slower flow across the mattress 100 allows some particulate to settle out on the mattress within its joints, adding to its stability.

Also extending from the upper surface 12 is a half dome 30. The half dome 30 is formed from a curvilinear wall 34, however the curvilinear wall 34 may alternatively be a tapered wall. The half dome 30 has at least one, preferably two, recesses 38 therein formed by a tapered walls 39 and recess walls 38*a*. The tapered wall 39 tapers from a wider top portion to a narrower bottom portion. The tapered wall 39 extends from a dome top 36 to lower surface 15 of revetment block 10. The half-dome 30 forms a full dome such as dome 13 when placed adjacent a revetment block having a half dome on an end adjacent half dome 30. The half-dome 30 also slows the velocity of water above the revetment mat 100 and encourages settlement of particulate into the apertures 18,20 of the mat 100.

As best shown in FIG. 4, there must be two types of block and a half end blocks. Right-hand block 10 has a matching left-hand block 110 which is structurally an equivalent mirror image of the right-hand block 10. The main difference is that dome 13 and half-dome 30 are reversed such that the half-dome 130 is on the left side of the block 110 and full dome 113 is located on the right side of the block 110. As clearly seen in FIG. 4, if the block 10 is used in place of block 110, then it would not properly align with the adjacent block of row 106. Therefore, a left-hand block 110 is used to complete the revetment mat 100 having aligned edges.

Figure 5:
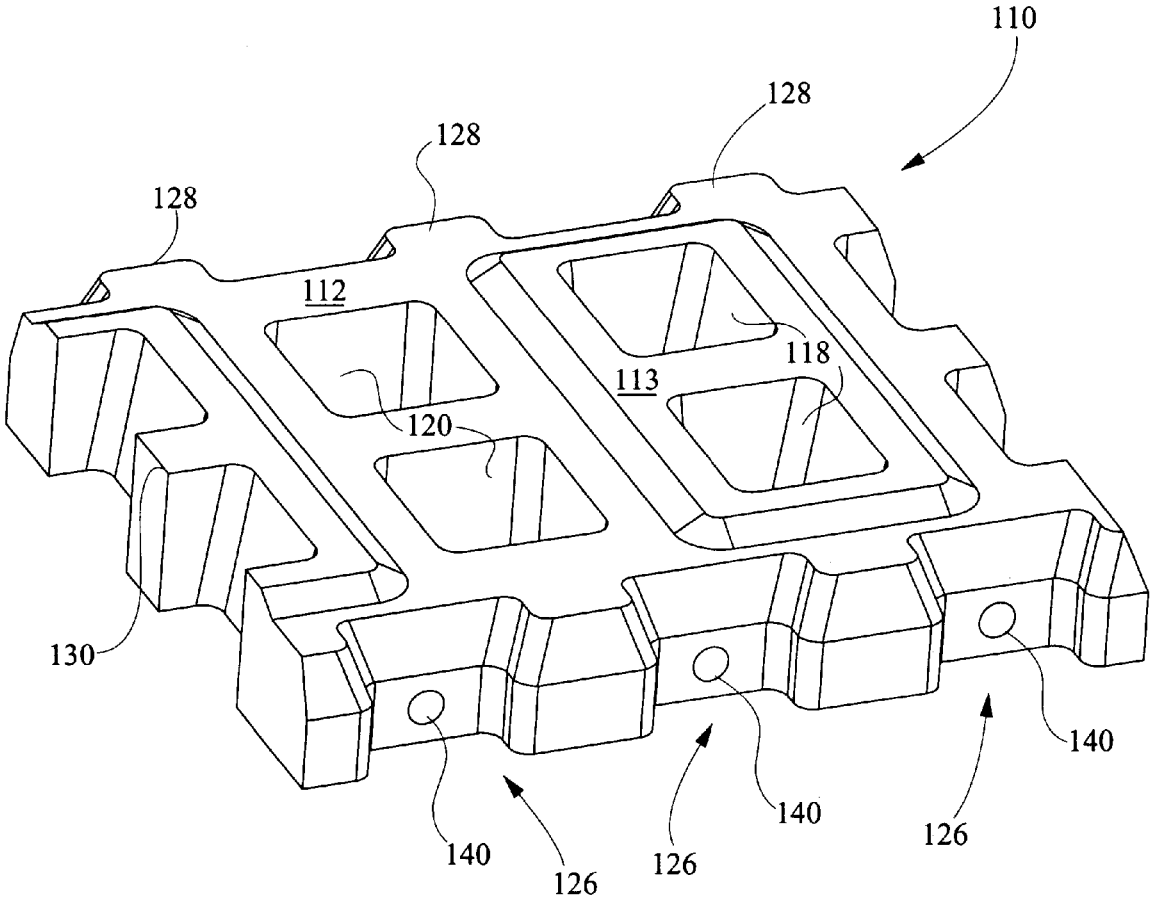
FIG. 5 shows a perspective view of the left-hand block and a half size revetment block of the present invention.
Figure 6:
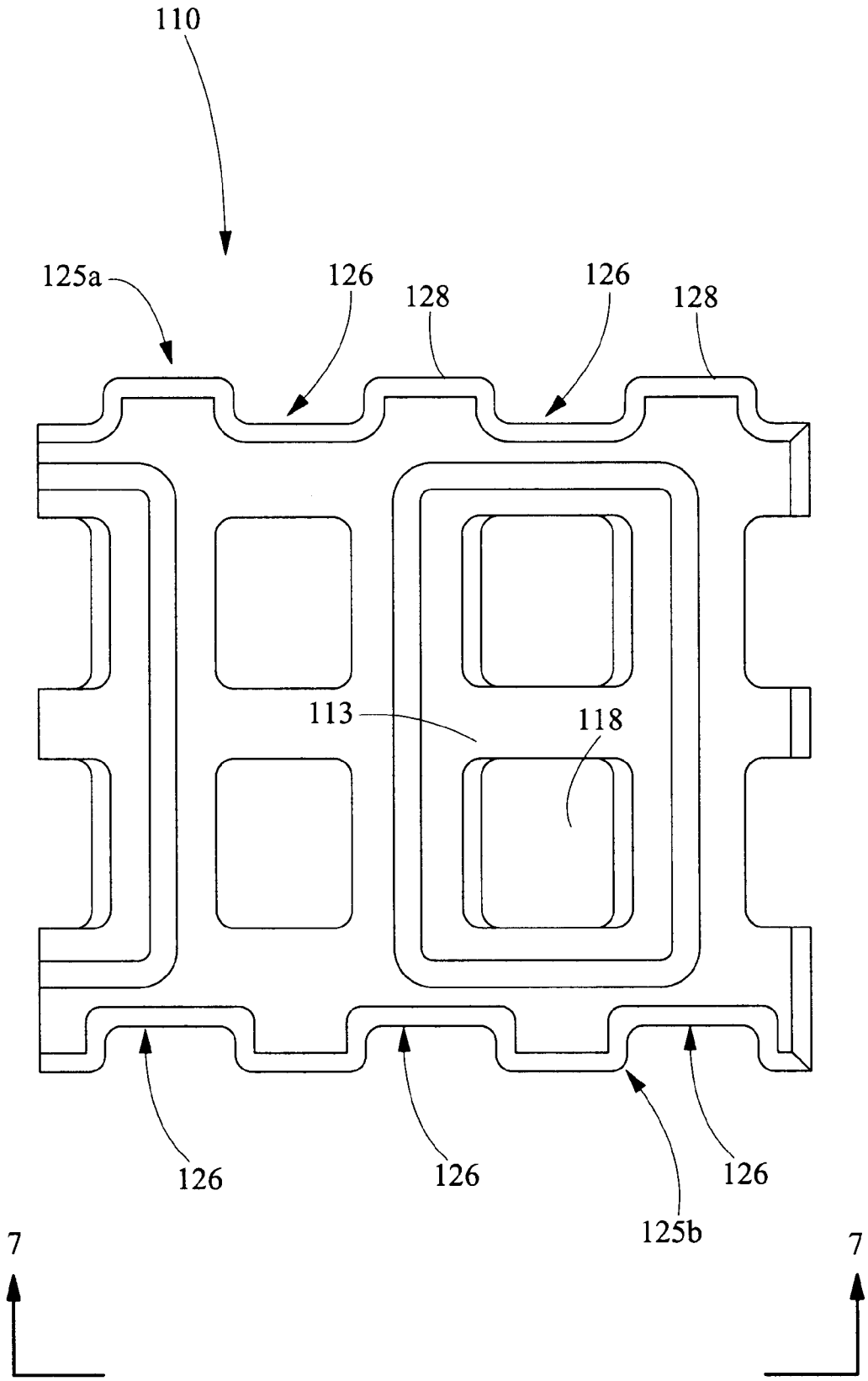
FIG. 6 shows a top view of the left-hand block and a half-size revetment block of FIG. 5.
Figure 7:
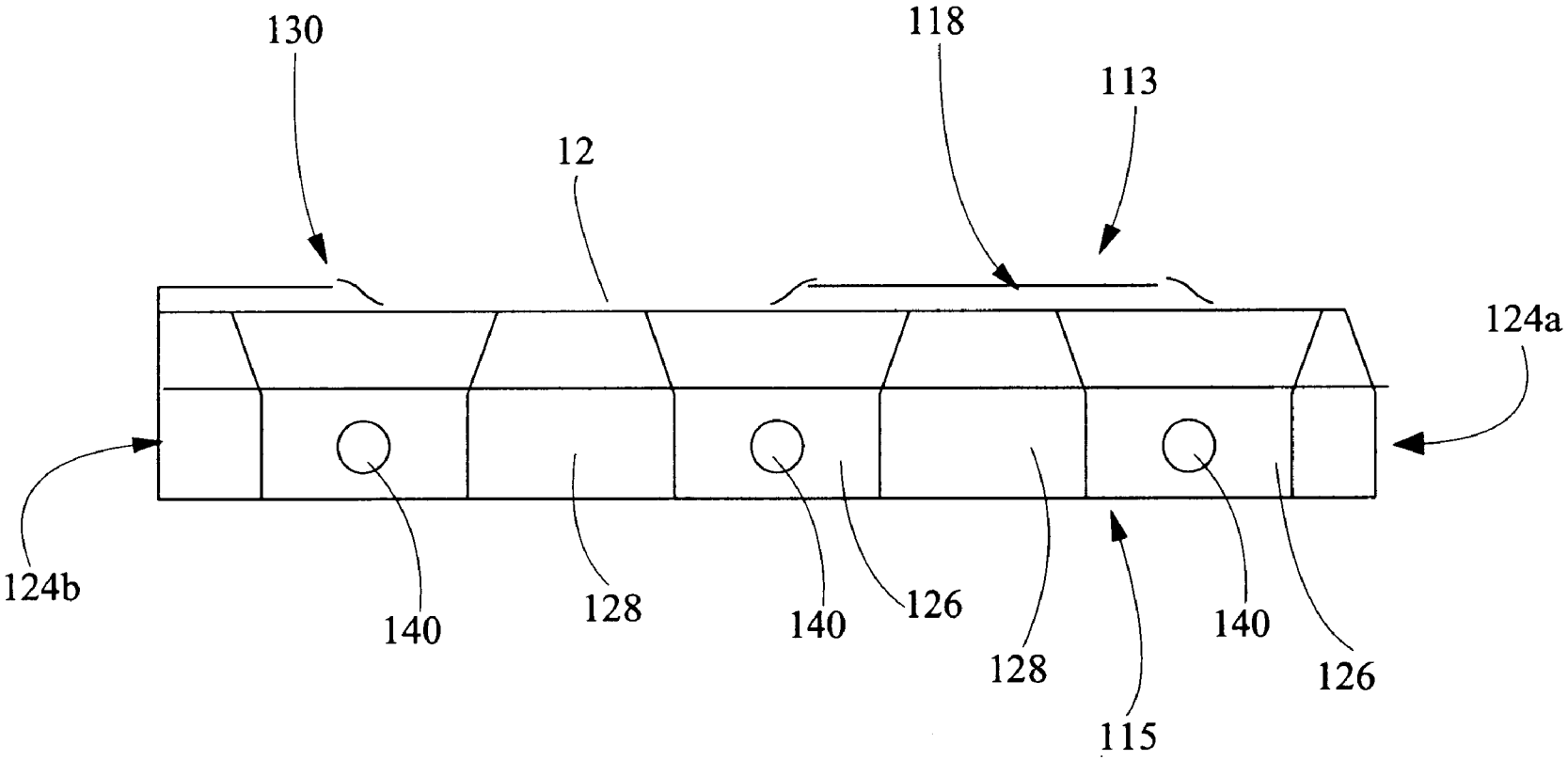
FIG. 7 shows a side view of the left-hand block and a half revetment block along line 3—3 of FIG. 6.

As shown in FIGS. 5, 6, and 7, left-hand block 110 is shown and is a mirror image of block 10. Left-hand revetment block 110 has a top surface 112, a bottom surface 115, and four sidewalls 124*a*, 124*b*, 125*a*, 126*b*. Referring to FIG. 6, a full dome 113 is shown on the right side and of the block 110 and a half-dome 130 is shown on a left side of block 110, opposite of the arrangement of block 10. Block 110 comprises apertures 118,120 corresponding to apertures 18,20 of block 10. Block 110 also comprises three recesses 126 along side 125*b* and three opposed projections 128 along side 125*a*. This arrangement allows proper alignment of openings and dome in revetment mat 100. Moreover, it also allows proper alignment of ducts 40 such that cable 42 can extend through the entire revetment mat 100.

The Revetment Mat

Figure 8:
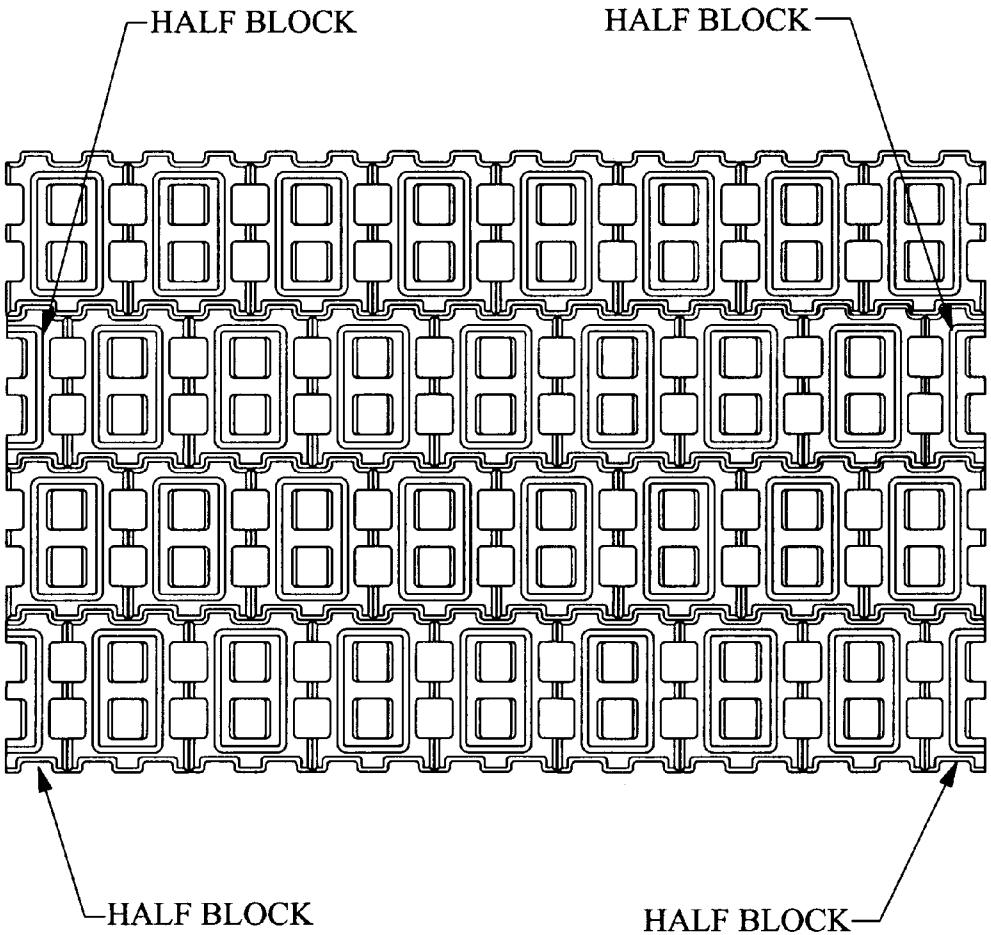
FIG. 8 shows a revetment mat using half-size revetment mat end blocks.

The plurality of interlocked revetment blocks 10,110 form a revetment mattress, matrix, or mat 100 as shown in FIG. 4. The mattress 100 may be formed of blocks 10,110 only but is preferably formed using smaller standard size blocks 104 having two projections across a top sidewall and two recesses across a bottom sidewall, as well. As shown in FIG. 4, a preferable method of forming the mattress 100 is with a running bond. The running bond is formed of offset rows of revetment blocks so that the mattress is interlocked and the blocks 10,104,110 contact at least four other blocks. However, the running bond results in rows of uneven alignment when equal numbers of blocks are used in each row. More specifically, alternating rows are a half block too short at each end and require a half block be added thereto. However, as discussed above there are problems associated with the use of half size blocks, shown in FIG. 8.

The mattress 100 may be formed of revetment blocks 10, 104, 110. In alternating rows, revetment blocks 10,110 are used at row 106 ends to effectuate a mattress 100 having rows of even alignment without the use of half size blocks. As a result, the problems associated with the half size blocks, such as lifting and twisting of the half block and curling of the mat edges are prevented due the shear resistance provided by blocks 10,110.

The revetment mat 100 is comprised of a first row 102 of standard size revetment blocks 104. The first row 102 can be of any desirable length for a given application while the mat 100 may consist of any number of desirable rows. A second row 106 is formed having a left-hand block and a half size revetment block 110 at a left end of row 106, a plurality of standard size blocks 104, and a right-hand block and a half size revetment block 10 at a right end of the second row 106 resulting in row 106 being evenly aligned with row 102.

The revetment mat 100 is constructed row by row until a desired size matrix is obtained. Preferably, the construction of the mattress 100 occurs at a manufacturing facility but may, instead occur at the site of the mattress installation. When the rows 102,106 are completed, a cable 42 is positioned through the ducts 40. The alignment of the recesses 26 and projections 28 of alternating rows cause the ducts 40 of the plurality of blocks 10 to be aligned. By using the revetment blocks 10,110 at each end of alternating rows, a mattress 100 is formed having evenly aligned edges without the use of half-size blocks, shown in FIG. 8.

Figure 10:
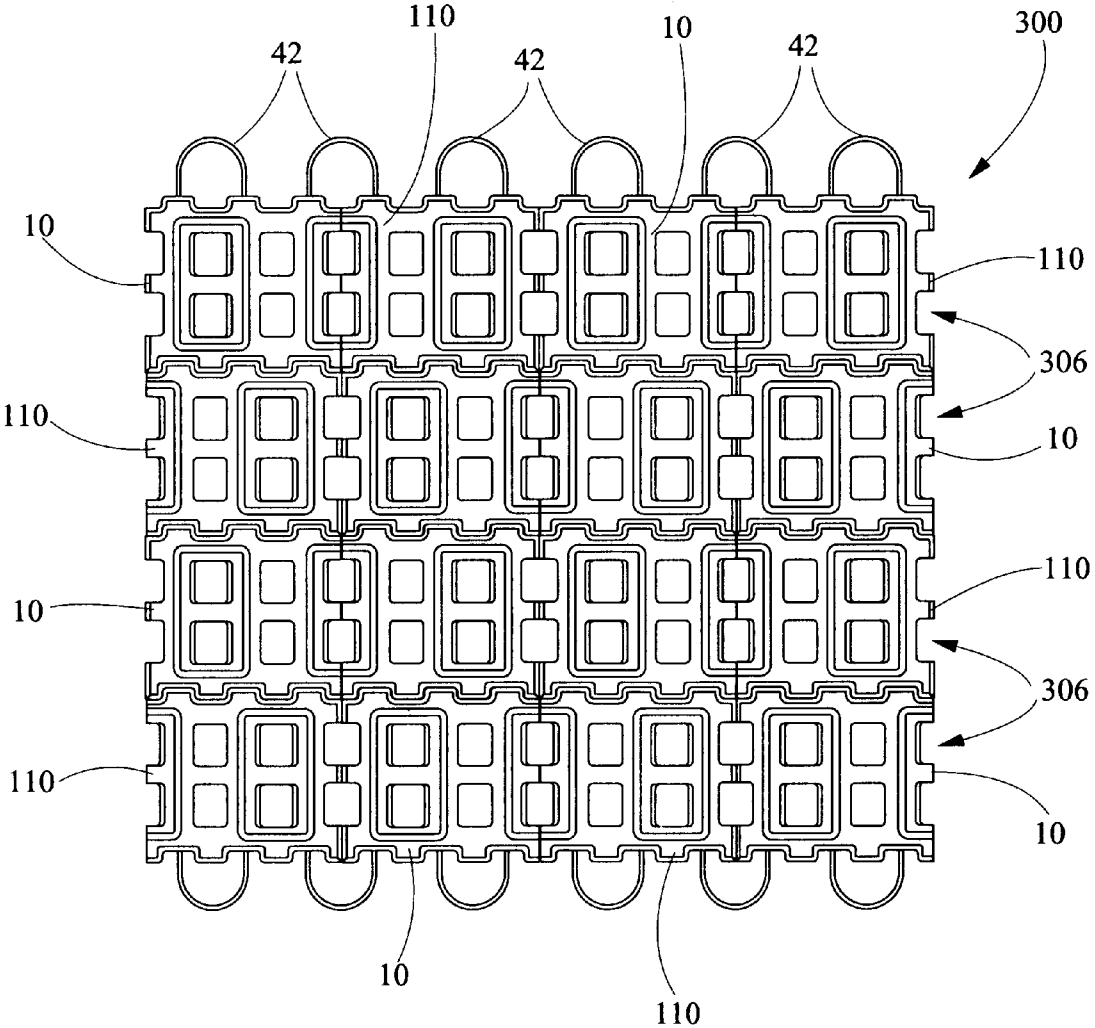

Alternatively, a revetment mat 300 may be formed of blocks 10, 110 only and is shown in FIG. 10. The rows 306 of the revetment mat 300 are formed by placing right hand blocks 10 and left-hand blocks 110 in an alternating scheme. The interlocking pattern of blocks 10, 110 also allow ducts 40 to be aligned and such that cable 42 may be used to interlock the blocks 10, 110. As shown in FIG. 10, the revetment mat 300 may have a parallel bond causing the edges of the revetment mat to be aligned.

Figure 9:
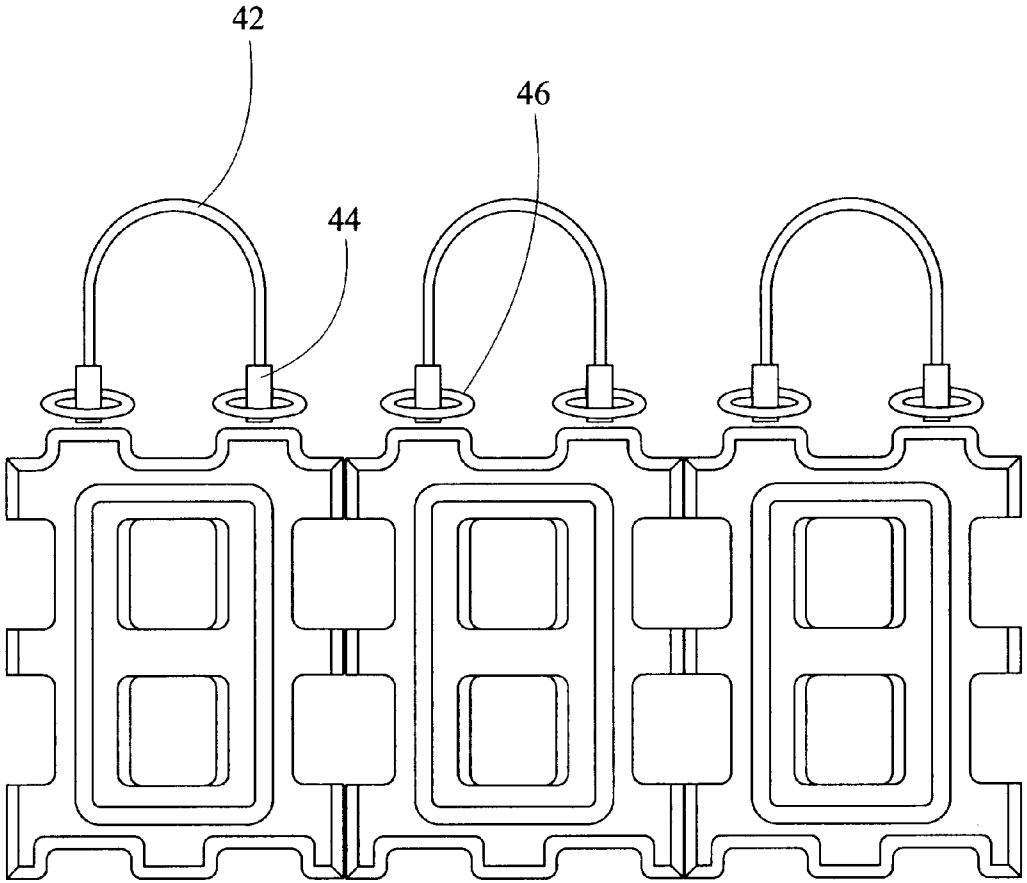
FIG. 9 shows a plan view of the cable, sleeves, and washers used in the revetment mat of the present invention; and, FIG. 10 shows a top view of a revetment mat formed of right-hand and left-hand block and a half-size revetment blocks of FIGS. 1 and 5.

Once the precast blocks are constructed into a mattress 100 or 300, a cable 42 is used to interlock the rows of mat 100. The cable is preferably stainless steel but may alternatively be made of galvanized stainless steel, or high strength polyester rope. Additionally, the cable or rope should exhibit excellent resistance characteristics to most acids, alkalis, and solvents and should also be impervious to rot, mildew, and microorganisms associated with marine environs. The cable 42 is preferably extended through ducts 40 when the mat 100 is fully formed. For example, a cable 42 may be started at side 25*b* of a first row and extend through duct 40 for the length of a revetment mat 100. At an opposite end of the mat 100 the cable may emerge from duct 40 at for instance side 25*a*. At each duct 40, a washer 46 and a sleeve 44 are placed on the cable 42 where it enters and exits the revetment mat 100, as shown in FIG. 9. The sleeves 44 are crimped on the cable 42 adjacent the duct holes 40 so that free movement of the cable 42 through the mattress 100 is inhibited. This process is continued until the mattress 100 is fully constructed.

Once this is completed, a filter medium or filter fabric 200 is placed over the substrate soil where the mattress 100 will be located. The filter fabric 200 inhibits erosion of the substrate soil 210 and is preferably made of a geotextile comprising a synthetic polymer such as propylene, ethylene, ester, or amide and inhibitors to resist deterioration due to ultraviolet and heat. Once the filter fabric 200 is positioned, the mattress 100 is moved by crane or other lifting device, preferably with the aid of a spreader bar, to a position above the filter fabric 200. Finally, the mattress 100 is lowered into the waterway, ramp, or channel and placed on top the filter fabric 200. In the alternative, the mat 100 may be constructed at the construction site instead of at a manufacturing facility. As discussed earlier, the blocks comprising mat 100 may have projections on a lower surface 15 increasing shear force resistance to the moving water.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

We claim:

1. A revetment block, comprising:

a substantially rectangular block having two U-shaped vertical recesses along each of first and second sides;

a third side having a pair of U-shaped recesses;

a fourth side having three U-shaped recesses;

said block having a top and a bottom surface;

said top surface further comprising at least one dome thereon;

a first and second openings extending vertically downward through said dome to said bottom surface of said block;

a third and fourth of openings extending from said top surface to said bottom surface;

said top surface further comprising a half-dome surrounding said pair of U-shaped recesses along said second side.

2. The revetment block of claim 1, said first and second sides being parallel, and said third and fourth sides being parallel.

3. The revetment block of claim 1, said first, said second, said third, and said fourth openings being substantially square.

4. The revetment block of claim 1, said first, said second, said third, and said fourth openings being substantially rectangular.

5. The revetment block of claim 1, said U-shaped recesses of said first and second sides each forming one-half openings being sized about one-half size of said third and fourth openings.

6. The revetment block of claim 1, said U-shaped recesses of said second side being surrounded by said one-half dome portion extending from said top surface.

7. The revetment block of claim 1, said U-shaped recesses of said second side having a tapered wall.

8. The revetment block of claim 1, further comprising at least one duct extending through said revetment block.

9. The revetment block of claim 8, said at least one duct extending longitudinally between said third and fourth sides.

10. The revetment block of claim 1, said first and second openings being vertically tapered from a wider upper portion to a narrower lower portion.

11. The revetment block of claim 1, said sidewalls being tapered between a vertical portion and said top surface of said revetment block.

12. The revetment block of claim 1, said dome and half-dome having tapered walls extending from said top surface to a flat upper plateau.

13. The revetment block of claim 1, said dome and half-dome exterior formed by curvilinear walls extending from said top surface to a flat upper plateau.

14. The revetment block of claim 1, said dome and half-dome exterior formed by tapered walls extending from said top surface to a flat upper plateau.

15. The revetment block of claim 1, said dome surrounding said first and second openings.

16. A revetment block, comprising:

a substantially rectangular block having two U-shaped vertical recesses along each of a first and a second side;

a third side having a first and a second U-shaped recess and three projections;

a fourth side, parallel to said third side, having three U-shaped recesses and a pair of projections;

a dome extending from a top surface of said block, said dome surrounding a first and a second tapered opening;

a third and a fourth opening adjacent said first and second tapered openings;

said U-shaped recesses of said second side being tapered and being formed from a half-dome;

said first, said second, said third, and said fourth openings being substantially rectangular and extending from a top surface to a bottom surface of said revetment block; and, at least one duct extending from said first side to said second side.

17. The revetment block of claim 16, said first and second sides being parallel.

18. The revetment block of claim 16, said sidewalls having a vertical portion and further comprising tapered walls between said vertical portion and said top surface.

19. A revetment block, comprising:

a substantially rectangular block having two U-shaped vertical recesses along each of first and second sides;

a third side having a pair of U-shaped recesses and three projections;

a fourth side having three U-shaped recesses opposing said three projections of said third side and a pair of projections opposing said recesses of said third side;

said block having a top and a bottom surface;

said top surface having a dome thereon, said dome surrounding a first and a second tapered wall opening;

a third and a fourth opening extending from said top surface to said bottom surface;

said first and second tapered wall opening extending vertically downward through said dome to said bottom surface of said block;

said second side further comprising a half-dome surrounding said pair of tapered U-shaped recesses;

said dome and said half-dome formed by a curvilinear wall extending from said top surface to a flat upper plateau;

said first, said second, said third, and said fourth openings being substantially rectangular; and, said U-shaped recesses of said first and second sides each forming one-half openings.

20. The revetment block of claim 19, further comprising at least one duct extending through said revetment block.

21. The revetment block of claim 20, said at least one duct extending longitudinally between said third and fourth sides.

22. The revetment block of claim 19, said first and second openings being vertically tapered from a wider upper portion to a narrower lower portion.

23. The revetment block of claim 19, said U-shaped recesses of said second side being tapered.

24. The revetment block of claim 19, said first, said second, said third, and said fourth side being tapered adjacent said top surface of said revetment block.

25. A revetment block, comprising:

a block having two U-shaped recesses within first and second opposed parallel sides;

a third side having a pair of U-shaped recesses;

a fourth side having three U-shaped recesses;

said third and fourth sides being opposed parallel sides, each of said third and fourths sides having an upper portion and a lower portion;

a top surface of said block having a dome with first and second openings extending downwardly therethrough;

a half-dome disposed on said top surface opposite said dome;

said two U-shaped recesses extending through said half-dome;

said top surface including third and fourth openings extending downwardly and positioned between said dome and said half-dome.

26. The revetment block of claim 25, said U-shaped recesses of said second side being sized about one-half of said first and second openings.

27. The revetment block of claim 25, said U-shaped recesses of said first side being sized about one-half of said third and fourth openings.

28. The revetment block of claim 25, said half-dome adjacent said second side and opposite said dome.

29. The revetment block of claim 25, said half-dome adjacent said first side and opposite said dome.

30. A revetment block, comprising:

a block having two U-shaped recesses within first and second opposed parallel sides;

a third side having a pair of U-shaped recesses;

a fourth side having three U-shaped recesses;

said third and fourth sides being opposed parallel sides;

said third side having ends each defining one-half U-shaped recesses and said fourth side having ends each defining one-half size projections;

a top surface of said block having a dome with first and second openings extending downwardly therethrough;

a half-dome disposed on said top surface opposite said dome;

said two U-shaped recesses extending through said half-dome;

said top surface including third and fourth openings extending downwardly and positioned between said dome and said half-dome;

said two U-shaped recesses being sized about one-half of said first and second openings.

31. A revetment block, comprising:

a block having two U-shaped recesses within first and second opposed parallel sides;

a third side having a pair of U-shaped recesses defined by a plurality of projections thereon;

a fourth side having three U-shaped recesses defined by a plurality of projections thereon;

said third and fourth sides being opposed parallel sides and each having an upper and a lower portion;

said third side having ends each defining one-half U-shaped recesses and said fourth side having ends each defining one-half size projections;

a top surface of said block having a dome with first and second openings extending downwardly therethrough;

a half-dome disposed on said top surface and opposite said dome wherein said two U-shaped recesses extend through said half-dome;

said top surface including third and fourth openings extending downwardly and positioned between said dome and said half-dome;

said recesses extending through said half-dome being about one-half size of said first and second openings;

said upper portion of said third and fourth sides being tapered inwardly.

32. The revetment block of claim 31 further comprising at least one duct extending between said lower portion of said third side and said fourth side.

33. A revetment block, comprising:

a block having two U-shaped recesses within first and second opposed parallel sides;

a third side having a pair of U-shaped recesses defined by a plurality of projections thereon;

a fourth side having three U-shaped recesses defined by a plurality of projections thereon;

said third and fourth sides being opposed parallel sides and each having an upper and a lower portion, the upper portion being tapered inwardly;

said third side having ends each defining one-half U-shaped recesses and said fourth side having ends each defining one-half size projections;

a top surface of said block having a dome with first and second openings extending downwardly therethrough;

a half-dome disposed on said top surface opposite said dome;

said two U-shaped recesses extending through said half-dome;

said top surface including third and fourth openings extending downwardly and positioned between said dome and said half-dome;

said two U-shaped recesses being sized one-half of said third and fourth openings;

said two U-shaped recesses being sized about one-half of said first and second openings.

34. The revetment block of claim 33, said U-shaped recesses of said fourth side defining projections positioned opposite said U-shaped recesses of said third side.

* * * * *